US005310079A

United States Patent [19]

Sandy et al.

[11] Patent Number: 5,310,079

[45] Date of Patent: May 10, 1994

[54] PARTS HANDLING CONTAINER

[75] Inventors: Charles M. Sandy, Geneseo, Ill.; Gregory G. Gooch, Davenport, Iowa; Gary E. Lovested, Rock Island, Ill.

[73] Assignee: Deere & Company, Moline, Ill.

[21] Appl. No.: 56,005

[22] Filed: May 3, 1993

[51] Int. Cl.[5] ..... B65D 8/00; B65D 5/46

[52] U.S. Cl. ..... 220/476; 220/755; 220/769; 220/771

[58] Field of Search ..... 220/476, 482, 755, 757, 220/767, 769, 771

[56] References Cited

U.S. PATENT DOCUMENTS

| | | | |
|---|---|---|---|
| 2,552,929 | 5/1951 | Bodkin | 220/769 |
| 4,038,719 | 8/1977 | Bennett . | |
| 4,717,038 | 1/1988 | Anders | 220/769 |
| 5,046,636 | 9/1991 | Coskery | 220/755 |
| 5,145,082 | 9/1992 | Craft, Jr. et al. | 220/755 |

*Primary Examiner*—Joseph Man-Fu Moy

[57] ABSTRACT

A parts tote includes a frame having transversely extending front and rear metal rod members connected by fore-and-aft extending side handle portions which include a hand grips of diameter of at least 1.25 inches for maximum use of hand strength. The handles extend at an angle of approximately 17 degrees from the horizontal so that the wrists remain straight while the tote is carried. The distance between the handles is set at shoulder width. The distance between the rod members is on the order of 12 inches or less to maintain a center of gravity close to the worker's body. One of several plastic containers or trays of differing depths, preferably on the order of 6 inches, may be snapped onto the frame. Tray side walls extend upwardly and diverge from the tray bottom to an upper edge location offset slightly inwardly and downwardly from the hand grip to provide substantial clearance for a gloved hand. Accessories, such as front brackets for hanging the tote from the upper edge of a shipping crate, may be attached to the metal rod portions of the frame by welding or other suitable method.

19 Claims, 2 Drawing Sheets

PARTS HANDLING CONTAINER

BACKGROUND OF THE INVENTION

1) Field of the Invention

The present invention relates generally to devices for carrying items, and, more specifically, to an ergonomically improved tote with handles.

2) Related Art

In many areas of industry, such as in manufacturing, processing or parts distribution, objects must be gathered or stored and moved by hand from one location to another in containers such as boxes, tubs or trays. A typical container often has a rolled top edge or similar structure which requires the fingers to lift and carry the load with no help from the thumb. The finger tips have only about twenty-five to thirty percent of the strength of the full hand, and therefore containers which rely on finger tip lift cause excessive stress and limit the amount of weight that can be safely lifted or carried.

Other types of containers which have hand cutouts on the side provide better use of full hand strength for lifting and carrying. However, as these types of containers are lifted, the wrist bends rather than remains straight. Bending of the wrist results in high physical stress, reduced hand strength, and reduced hand and eye coordination. Additional problems with cutouts include lack of clearance for easy insertion of a gloved hand and the relatively small contact area between the hand and the thin upper portion of the cutout which results in the topside of the handle cutting into the hand. The sharper the carrying edge that contacts the hand, the less load the hand can support.

Some containers include handles that require the hands to be spread widely during lifting and carrying. Large tray length with the resultant increased hand spread place more of the load on weaker muscles of the shoulder rather than on the strong bicep muscles and limits the load that can comfortably be carried.

Container width (front to back distance) directly influences load center of gravity. Many of the wider containers of the prior art cause more low back stress as the center of gravity moves forward.

BRIEF SUMMARY OF THE INVENTION

It is therefore an object of the present invention to provide an improved tote or container which overcomes many or all of the aforementioned problems associated with prior art containers.

It is a further object of the present invention to provide an improved tote or container which significantly lessens wrist fatigue and better utilizes hand strength compared to at least most previously available totes and containers. It is another object to provide such a device which reduces stress on the hands, wrists and back.

It is still another object of the present invention to provide an improved tote or container having handles which accommodate a power grip with gloved hands. It is another object to provide such a device which reduces wrist stress, maximizes use of hand strength, and enhances hand and eye coordination.

It is yet another object of the invention to provide an improved ergonomic tote which is relatively simple and inexpensive in construction. It is another object to provide such a tote having a handle frame that easily accommodates different attachments and containers of differing depths.

A tote constructed in accordance with the teachings of the present invention includes a steel frame having transversely extending front and rear metal rod members connected by fore-and-aft extending side handle portions which include a hand grips of diameter of at least 1.25 inches for maximum use of hand strength. The handles extend at an angle of approximately 17 degrees from the horizontal so that the wrists remain straight while the tote is carried in a generally level attitude with the worker's arms fully extended. The distance between the handles is set at about 20 inches, which is approximately shoulder width for most workers. The distance between the rod members is on the order of 12 inches or less to maintain a center of gravity close to the worker's body.

One of several plastic containers of differing depths, preferably on the order of 6 inches, is attached to the metal rod members and extends downwardly therefrom to a container bottom. Sidewalls extend upwardly and diverge from the bottom to an upper edge location offset slightly inwardly and downwardly from the hand grip to provide substantial clearance for a gloved hand. Accessories, such as front brackets for hanging the tote from the upper edge of a shipping crate, may be attached to the metal rod portions of the frame by welding or other suitable method. The use of a common handle frame for different sizes of trays or containers simplifies construction, provides versatility and reduces manufacturing costs.

These and other objects, features and advantages of the present invention will become apparent to one skilled in the art upon reading the following detailed description in view of the drawings.

DETAILED DESCRIPTION OF THE DRAWINGS

Figure 1:
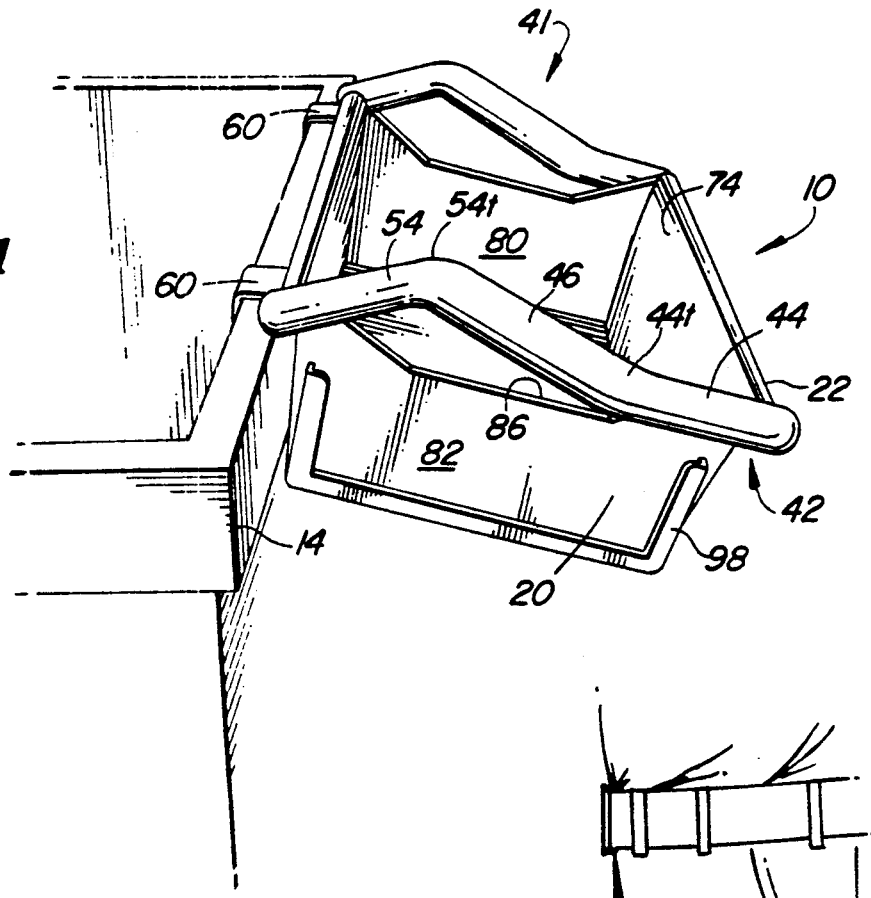
FIG. 1 is a perspective view of a tote constructed in accordance with the teachings of the present invention and attached to the upper edges of a shipping crate.

Referring now to the FIG. 1, therein is shown a tote 10 supported on the upper edge 12 of a shipping crate 14. The tote 10 includes a molded plastic container or tray 20 releasibly connected to an upper handle frame 22 which generally surrounds the entire upper portion of the container 20. Trays of different sizes can be selectively supported from the frame 22.

The upper frame 22 includes a forward metal rod member 26 (FIG. 3) having short rearwardly extending ends 27 and 28. The frame 22 also includes a rear metal rod member 30 having forwardly and upwardly extending ends 31 and 32. The rod members as shown are fabricated from rust-protected steel round of diameter of approximately 0.375 inch. The rod ends are transversely spaced from each other less than 20 inches, preferably about 18.25 inches.

Molded over the rod ends 27,28 and 31,32 are handle structures 41 and 42. The handle structure 42, which is essentially the mirror image of the handle structure 41, includes a rear horizontal portion 44 extending around and forwardly from the rod end 28 to an enlarged grip portion 46 which extends upwardly in the forward direction from portion 44 at an angle of approximately 17 degrees. The grip portion 46 has a length of approximately 6 inches and a diameter of approximately 1.25 inches. The diameter of the rear portion 44 is slightly less (on the order of 1.0 inch) and tapers at transition area 44*t* (FIG. 3) to the grip diameter. The tray 20 has a centerline 50, and a vertical plane (see 50*p* of FIG. 2) passing through the centerline 50 essentially bisects the top of the handle portion 46. The forward end 54 of the handle structure 42 tapers at 54*t* to a reduced diameter portion which surrounds the end 32 and terminates slightly forwardly of the metal rod member 30. The end 54 is angled downwardly from the horizontal and from the forward end of the grip portion 46. Bracket structure 60 is fixed to the metal rod member 30 and permits the tote to be supported from the edge 12 (FIG. 1).

The tray 20 includes a horizontal bottom 70 with front and rear walls 72 and 74 diverging in the upward direction to uppermost lipped portions 76 and 78, respectively, which extend parallel to the bottom 70. The lipped portions 72 and 74 snap over the rod members 26 and 30. The entire tray 20 may be replaced with a different tray simply by removing the upper frame from the lips and placing the lipped portions of the new tray over the rods 26 and 30.

Figure 2:
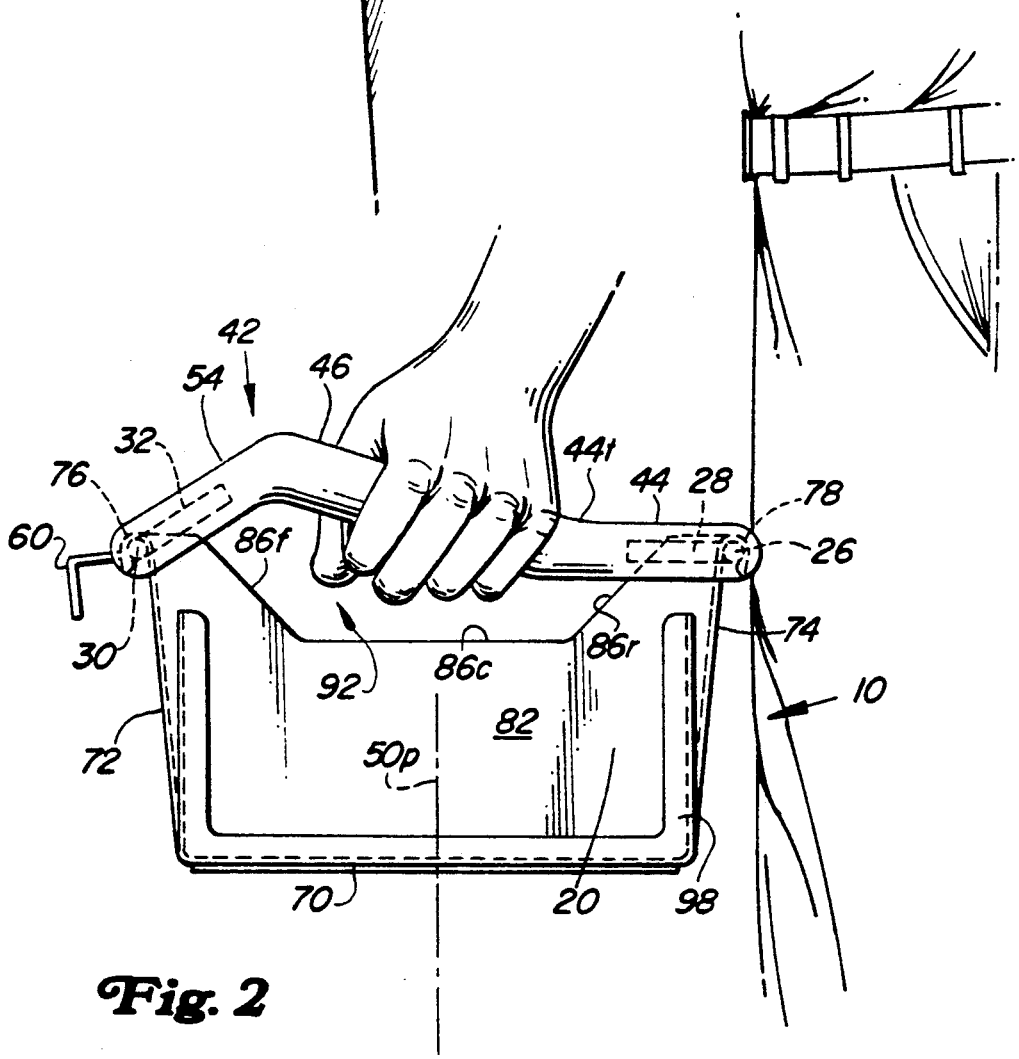
FIG. 2 is an end view of the tote of FIG. 1.

Outside walls 80 and 82 extend upwardly and diverge outwardly from the bottom 70 to uppermost edges 84 and 86. The walls 80 and 82 extend between the front and rear walls 72 and 74, and the upper edges 84 and 86 define hand accommodation spaces 90 and 92. As best seen in FIG. 2, the lowermost extremity of forward end of the grip portion 46 is located above the plane of the lips 76 and 78, and the upper edge 86 angles downwardly and rearwardly at 86*f* to a horizontal central edge portion 86*c* located below the grip portion 46. The edge 86 angles upwardly toward the rear lip 78 at 86*r*. The edge 84 on the opposite side of the tote is substantially identical to the above described edge 86.

The tray bottom 70 includes reinforcing ribs 96 for strength. A ticket or card holding bracket 98 is supported on the side wall 82 inwardly of the corresponding portion 46. A similar bracket 100 is supported on the opposite wall 80.

Figure 3:
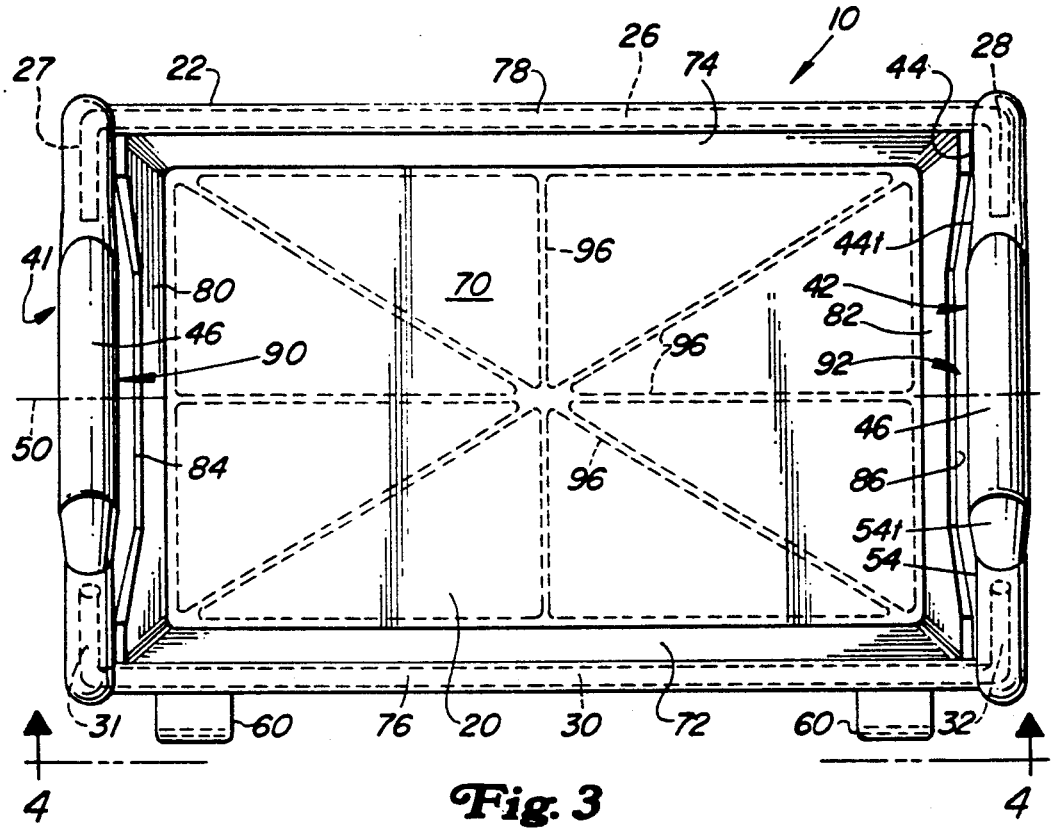
FIG. 3 is a top view of the tote of FIG. 1.
Figure 4:
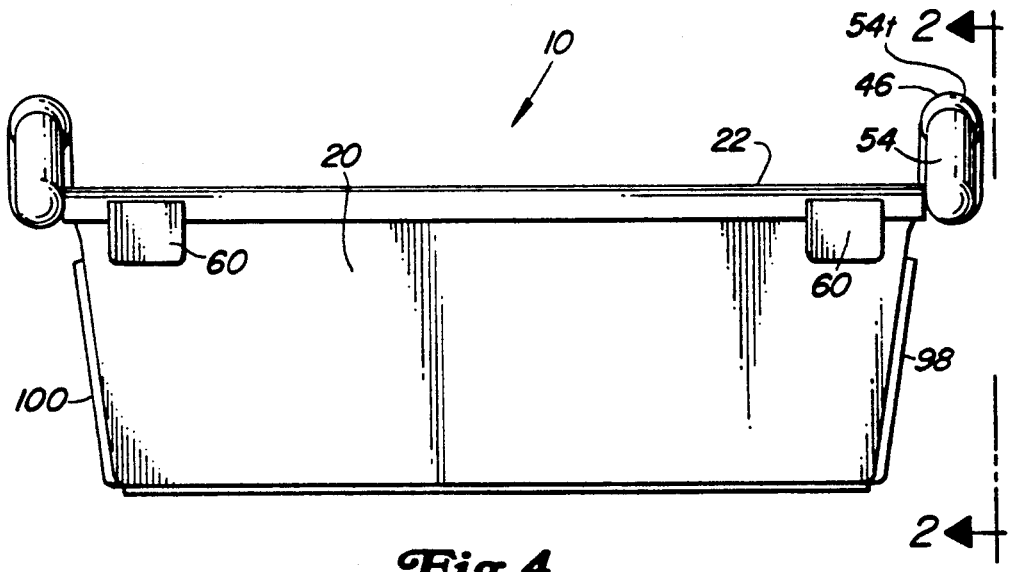
FIG. 4 is rear view of the tote taken generally along lines 4—4 of FIG. 3.

As can best be appreciated from FIG. 3, the upwardly diverging walls 80 and 82 and edges 84 and 86 provide the accommodation spaces 90 and 92 with hand clearance offset both vertically and horizontally from the grip portions 46. The angle of the grip portions 46 with respect to the horizontal permits the wrist to remain straight (FIG. 2) in the normal arms extended carrying position. The relatively large diameter of the grip portions 46 provides good use of hand strength. The front to back distance of the tote, which as noted above is preferably about 12 inches or less, maintains the center of gravity close to the body (FIG. 2) for better back comfort. The rear wall 74 is located close to the person at a location just below waist height.

Having described the preferred embodiment, it will become apparent that various modifications can be made without departing from the scope of the invention as defined in the accompanying claims.

We claim:

1. A tote to be used by a person for carrying articles by hand, the tote comprising:

a tray having a horizontal bottom with front and rear walls extending upwardly from the bottom, and fore-and-aft extending outside walls located between the front and rear walls, the tray defining a centerline extending transversely between the side walls;

handle structure comprising a pair of hand grip portions having a generally rounded cross-section of diameter substantially greater than one inch; and an upper handle frame supporting the hand grip portions at locations transversely spaced a distance of approximately 20 inches with the hand grip portions extending upwardly in the forward direction at an angle of approximately 17 degrees from the horizontal, and means supporting the tray below the hand grip portions such that a vertical plane extending upwardly through the centerline passes through the hand grip portions.

2. The invention as set forth in claim 1 wherein the means supporting the tray includes means for releasibly connecting the tray to the upper handle frame.

3. The invention as set forth in claim 2 wherein the means for releasibly connecting the tray includes a downwardly opening lip portion located on one of the front and rear walls.

4. The invention as set forth in claim 1 wherein the upper handle frame includes a metal frame portion having front and rear transversely extending rod members, and the tray includes an upper attaching portion for releasibly connecting the tray to the rod members.

5. The invention as set forth in claim 4 wherein the rod members include fore-and-aft extending end portions, and wherein the hand grip portions are molded around the end portions.

6. The invention as set forth in claim 1 wherein the tray outer walls include hand accommodation spaces located below the hand grip portions.

7. The invention as set forth in claim 6 wherein the outer walls diverge outwardly from the tray bottom and include top edges which terminate below and transversely inwardly from the hand grip portions.

8. The invention as set forth in claim 7 wherein the top edges of the outer walls extend downwardly from the front and rear walls to edge portions located below the handle portions and thereby define the lowermost extremities of the accommodation spaces, the lowermost extremities terminating inwardly of the inwardmost portions of the hand grip portions to facilitate movement of the hands into a gripping position relative to the hand grip portions.

9. The invention as set forth in claim 4 further comprising bracket structure fixed to the metal frame portion.

10. The invention as set forth in claim 1 wherein the tray further comprises a paper holding bracket supported on one of the outer walls inwardly of the inwardmost portion of the corresponding hand grip portion.

11. A tote to be used by a person for carrying articles by hand forwardly and below the waist of the person with the arms extended downwardly and substantially straight, the tote comprising:

a tray having a horizontal bottom with front and rear walls extending upwardly from the bottom, and fore-and-aft extending outside walls located between the front and rear walls;

handle structure comprising a pair of hand grip portions having a generally rounded cross-section of diameter substantially greater than one inch, the hand grip portions at locations transversely spaced a distance approximately shoulder width;

means supporting the tray below the hand grip portions such that a transversely extending vertical plane extending upwardly through the center of the tray passes through the hand grip portions; and wherein the hand grip portions extend upwardly in the forward direction at an angle of approximately 17 degrees from the from the plane of the bottom of the tray such that when the person grips the grip portions with his arms straight and extending downwardly with the rear wall of the tray adjacent his lower body, his wrists remain substantially unbent while the bottom of the tray remains horizontal.

12. The invention as set forth in claim 11 wherein the means supporting the tray includes means for releasibly connecting the tray to the handle structure.

13. The invention as set forth in claim 12 wherein the means for releasibly connecting the tray includes a downwardly opening lip portion located on one of the front and rear walls.

14. The invention as set forth in claim 11 wherein the handle structure includes a metal frame extending transversely between the hand grip portions.

15. The invention as set forth in claim 14 wherein the means supporting the tray includes lipped structure insertible over the metal frame.

16. The invention as set forth in claim 11 wherein the tray outer walls include hand accommodation spaces located below the hand grip portions.

17. The invention as set forth in claim 16 wherein the outer walls diverge outwardly from the tray bottom and include top edges which terminate below and transversely inwardly from the hand grip portions.

18. The invention as set forth in claim 17 wherein the top edges of the outer walls extend downwardly from the front and rear walls to edge portions located below the handle portions and thereby define the lowermost extremities of the accommodation spaces, the lowermost extremities terminating inwardly of the inwardmost portions of the hand grip porions to facilitate movement of the hands into a gripping position relative to the hand grip portions.

19. The invention as set forth in claim 14 further comprising tote support bracket structure fixed to the metal frame.

* * * * *